US008191295B2

(12) United States Patent
Junkins et al.

(10) Patent No.: US 8,191,295 B2
(45) Date of Patent: Jun. 5, 2012

(54) INTERCHANGEABLE ADVERTISING SIGN

(76) Inventors: Mitch Junkins, Newport Beach, CA (US); Michael Stastny, Newport Beach, CA (US)

( * ) Notice: Subject to any disclaimer, the term of this patent is extended or adjusted under 35 U.S.C. 154(b) by 37 days.

(21) Appl. No.: 12/298,015

(22) PCT Filed: May 1, 2007

(86) PCT No.: PCT/US2007/010661

§ 371 (c)(1),
(2), (4) Date: Jun. 2, 2009

(87) PCT Pub. No.: WO2007/130473

PCT Pub. Date: Nov. 15, 2007

(65) Prior Publication Data

US 2009/0320342 A1 Dec. 31, 2009

Related U.S. Application Data

(60) Provisional application No. 60/796,674, filed on May 1, 2006.

(51) Int. Cl.
*G09F 7/00* (2006.01)

(52) U.S. Cl. ..... 40/611.06; 40/611.01; 206/455

(58) Field of Classification Search ..... 40/661.06; 206/461, 462, 465, 464
See application file for complete search history.

(56) References Cited

U.S. PATENT DOCUMENTS

| | | | | |
|---|---|---|---|---|
| 1,921,202 | A * | 8/1933 | Mungen | 40/611.06 |
| 1,996,616 | A * | 4/1935 | Gross | 40/652 |
| 2,086,860 | A * | 7/1937 | Erickson | 40/611.06 |
| 2,305,547 | A * | 12/1942 | Myers | 206/465 |
| 2,588,183 | A * | 3/1952 | Vigon | 40/542 |
| 4,245,414 | A * | 1/1981 | Shypula | 40/124 |
| 5,542,202 | A * | 8/1996 | Brugger | 40/576 |
| 5,878,884 | A * | 3/1999 | Mayled | 206/455 |
| 6,578,302 | B1 * | 6/2003 | Benaquista et al. | 40/611.06 |
| 6,688,027 | B2 * | 2/2004 | Fink | 40/611.08 |

* cited by examiner

*Primary Examiner* — Casandra Davis
(74) *Attorney, Agent, or Firm* — Hani Z. Sayed; Rutan & Tucker, LLP

(57) ABSTRACT

A system and a method for advertisement for a business is provided. The contemplated embodiments of the system and method utilize a sign having interchangeable capabilities such that the sign may be changed based on promotional programs and or may be changed to display new design for advertisement. Additionally, a contemplated embodiment of the system and method utilize a sign that may be interchangeable and moreover may display three dimensional promotional materials including toys, small articles among others. The invention may comprise a plurality of parts including a first backboard portion having a plurality of slots wherein a second promotional material may be inserted in the backboard portions and may be removable inserted and interchanged based on desired promotions and display materials.

10 Claims, 4 Drawing Sheets

INTERCHANGEABLE ADVERTISING SIGN

CROSS REFERENCE TO RELATED APPLICATION

This application is related to and claims priority from the U.S. PCT patent application Ser. No. PCT/2007/010661 filed on May 1, 2007, which claims priority to U.S. Provisional patent application No. 60/796,674, filed on May 1, 2006.

FIELD OF THE INVENTION

The field of the invention is for advertising implements. More specifically, the field of invention is for an advertising sign that has interchangeable pieces.

BACKGROUND

The history of advertising goes back for almost as long as human civilization. Advertising goes back centuries to when merchants would hang or prop wooden, stone, or other type of signs to advertise and/or describe their goods. Typically, these types of signs were crude and gave very limited information about the products and/or service offered by the merchant. Later in the evolution of advertising, merchants realized that the more elaborate and unique their signs were, the more business it might attract. Colors, symbols and other advertising means were incorporated along with other information that might grab the consumer attention. Lighting and other colors were introduced that sought to bring greater attention to the merchant's product, even if the product was no more glamorous or different than the competitors in the market. Over time, new and inventive ways are utilized to advertise goods and services. Many current methods use the internet, and electronic devices to directly communicate with the consumer in an effort to attract additional business. Commercial signs are used from freeway exits to internet websites. Any type of information that will attract the attention of a buyer is now used/

Advertising signs have the effect of increasing business revenue and sales results for many companies. The correlation between effective advertising and sale opportunity is well studied and well known. Effect signage can create better visible business which may correlate with additional consumers and higher sales totals. Additionally, signs are an affordable means of advertisement for many businesses. Most advertisements signs are constructed of cheap paper or paper products, can be used for a period of time and then discarded when the advertisement is no longer appropriate or undesired. Moreover, advertising signs may allow a business the opportunity to advertise certain promotional programs, sales, give-a-ways, or other promotional material that may stimulate sales growth with that business. Of course there are several ways a business may advertise for their business including radio, billboards, televisions, and many others. Compared to other forms of advertisements, price for price, signs are the most effective and the most cost efficient for most businesses.

Additionally, advertising signs may be much more portable and viewable at the point of sale. A potential purchaser is more subjected to point of sale advertising than any other advertising medium. The purchaser may be more likely to purchase an advertised item or advertised sale, if the advertisement is prominently displayed at the point of sale, and may be more influenced by the point of sale advertisement.

The use of the right sign can increase customers and profits for a business. By and large, advertising signs are traditionally the most effective and least costly. Business owners typically view signage as a capital investment and not as an expense. The price of a sign varies depending on the size, style, design, and the manufacturer. Once the sign has been paid for, it is on display almost immediately and acts as a marketing tool for a period of time, bringing in the business, and paying for themselves in a short amount of time.

Effective signage may help bring in numerous customers in a particular area, or surrounding area. Effective signage may also help to keep a product fresh and unique long after that product has been on the market.

However, a problem with advertisement signs, is that they have very short shelf life. More specifically, advertisement signs may be a hugely effective way of reaching potential customers. However, when an advertisement sign has been displayed too long, its effectiveness drops exponentially. Consumers may get used to the signage and no longer see it has fresh and its effectiveness may now not garner what the business intends. Therefore, a need exists for a sign that can be interchanged and re-used by a business.

Additionally, another problem that exists is that advertisement signs may be time specific and may advertise a certain promotion that is only run for a set period of time. Once the promotion has run its course, the sign must be discarded and/or thrown away. Thereafter, if the business intends to run a new promotion, it must then make all new signs to display the new promotional materials. Therefore, a need exists for a advertisement sign that may display current promotional material and thereinafter, be able to be modified and interchanged with new promotional materials when a new promotion is being advertised.

A further problem exists such that many signs cannot display three dimensional material, such as toys or other small articles. The traditional prior art signs are limited to two dimensional advertising of these articles. They do not attract the potential interest of an customer the way a three dimensional display can. Moreover, even if a three dimensional promotional material signage is displayed, these signs cannot be changed sufficiently when new promotional three dimensional material is added or replaces the original promotional material. Therefore, a need exists for a promotional sign that may display three dimensional material and may allow for interchangeability of the material on the advertisement sign.

SUMMARY OF THE INVENTION

The present invention provides a system and a method for advertisement for a business. The contemplated embodiments of the system and method utilize a sign having interchangeable capabilities such that the sign may be changed based on promotional programs and or may be changed to display new design for advertisement. Additionally, a contemplated embodiment of the system and method utilize a sign that may be interchangeable and moreover may display three dimensional promotional materials including toys, small articles and others. The invention may comprise a plurality of parts including a first backboard portion having a plurality of slots wherein a second promotional material may be inserted in the backboard portions and may be removable inserted and interchanged based on desired promotions and display materials.

Among the many different possibilities contemplated, the system may allow for a business to use the advertising sign for long periods of time while keeping the advertisement fresh and different with time.

Additionally, in an exemplary embodiment, the system may use a plurality of parts including a rigid backboard and an insert portion.

In yet another exemplary embodiment, it is contemplated that the system may utilize an insert portion wherein the insert portion may be adaptable for three-dimensional display capabilities.

In another exemplary embodiment, it is contemplated that the system may allow a business to interchange the insert portion of the advertising sign when a new promotion is to be run allowing for a new sign to be used in association with the new promotion.

A further exemplary embodiment contemplates that the system may allow for a portion of the backboard to be seen consistently even when the insert in place wherein the viewable portion of the backboard may display the name of the business or like desired identification purposes.

Further, a contemplated embodiment of the system may be the inclusion of side slots in the backboard portion wherein the side slots may provide easy insertion and removal of the insert portion of the display sign and may further allow for proper securement of the insert portion when coupled with the backboard portion Additionally, in an exemplary embodiment, the system may allow for the positioning of multiple insert portions into the backboard portion wherein the insert portions may advertise multiple promotions and/or multiple items.

In operation, advertising media has many advantages. It can be used in to promote a promotion, sales and the like. Additionally, advertising media may be used to garner interest in a particular product or event. For example, a store may wish to promote a sale, such as a sale for merchandise that gives the buyer a certain percentage off the price off, such as 50% off the purchase price. The store owner may wish to promote this sale using a sign that advertises the fact that a shopper/buyer would receive a discount with the sale. This advertisement may encourage a buyer to shop in that store based on the 50% off promotion. In this way, the advertisement may support business and may increase profitability of the store. Therefore, it is advantageous for the store owner to use such an advertising sign. However, typically these promotional campaigns only last a pre-set duration of time, such as, a month. After that month, the store owner may want to advertise a new promotions, such as zero percent financing, or the like. The old signs advertising signs promoting the 50% off sale are no longer valid and will have to be discarded. The constant change over of promotions can be quite costly from an advertising standpoint.

The new advertising sign in the present invention contemplates an interchangeable sign wherein the sign has a backboard and an insert portion wherein when the store owner desires to change the promotions, all he/she needs to do is remove the insert portion of the advertising sign and the new promotional material into the pre-set slots in the backboard portion. Additionally the backboard portion may have a portion thereof that may be always visible even when an insert portion is coupled to the backboard portion. This visible portion of the backboard portion may be valuable in illustrating the name of the business, certain advertising slogans, logos, and other advertising tools.

Moreover, the advertising sign may allow for display of three dimensional promotional material such as toys, small articles, and the like. The three dimensional promotional material may be contained on the insert portion of the advertising sign and further wherein the insert portion of the advertising sign may be removably coupled to the backboard portion. Additionally, in an exemplary embodiment, the insert portion may be hinged such that the three dimensional display material may be removed and replaced with new promotional material when so desired by the advertiser.

A further exemplary embodiment of the present invention may include an advertising sign wherein the sign has a plurality of portions wherein the portions may be coupled together to display promotional material.

Another exemplary embodiment may include a system and a method for advertising wherein a sign is provided. The sign may have a plurality of parts wherein a backboard portion and an insert portion may be coupled together to form a sign. However, it is further contemplated that the backboard portion may have a pre-designed indicia thereon wherein even if no insert portion is coupled together with the backboard, the backboard may function alone as an advertisement means.

Various objects, features, aspects and advantages of the present invention will become more apparent from the following detailed description of preferred embodiments of the invention, along with the accompanying drawings in which like numerals represent like components.

DETAILED DESCRIPTION OF THE PREFERRED EMBODIMENT

Turning now to the drawings wherein elements are identified by numbers and like elements are identified by like numbers throughout the figures, FIG. 1 illustrates the advertising display system 1 that allows for advertising and marketing of a product and/or service to a consumer.

Figures 1A, 1B:
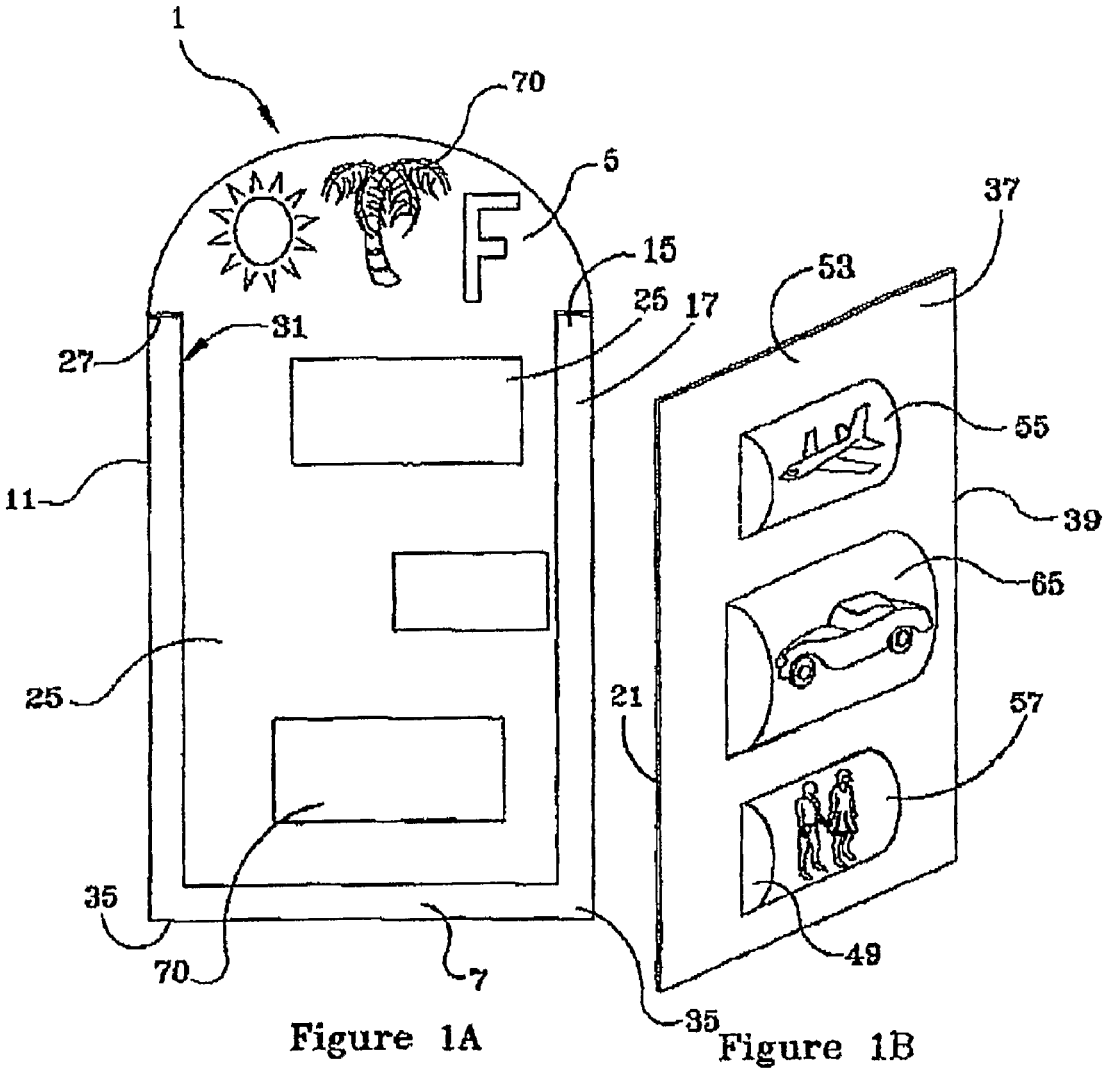
FIG. 1 is a schematic of the invention illustrating the advertising system including the backboard portion and the insert portion.

FIG. 1A illustrates the backboard portion 3 of the advertising display system 1. The backboard portion 3 may have a top section 5, bottom section 7 and a first side section 9 and a second side section 11. The top section 5 may have a plurality of different shapes and sizes and may extend away from the top portion 15 of the side sections 9, 11. In an exemplary embodiment of the present invention, a first side extension 17 and a second side extension 19 may be disposed on the outside portion 21, 23 of the first and second side sections 9, 11. The first side extension 17 and the second side extension 19 may be configured to loop around and extend back into the front portion 25 of the backboard portion 3. The distal end 27 of the first side section 9 may overlap the front portion 25 of the backboard portion 3. However, an opening 31 and/or space may be included between the distal end 27 of the first side section 9 and the proximal end 35 of the side section 9. The space 31 is of sufficient size to allow for insertion and removal of the insert portion 37 illustrated in FIG. 1A.

FIG. 1A illustrates the insertion portion 37 that may be sized with a width smaller than the width of the backboard portion 3 of the advertising display system 1. The insert portion 37 may have a first outer edge 39 and a second outer edge 41 whereby the first outer edge 39 may be introduced into the space 31 provided by the first side section 9 of the backboard portion 9. Additionally, the second outer edge 41 of the insert portion 37 may be introduced and inserted into the second space 45 of the second side section 11 of the backboard portion 9.

Figure 5:
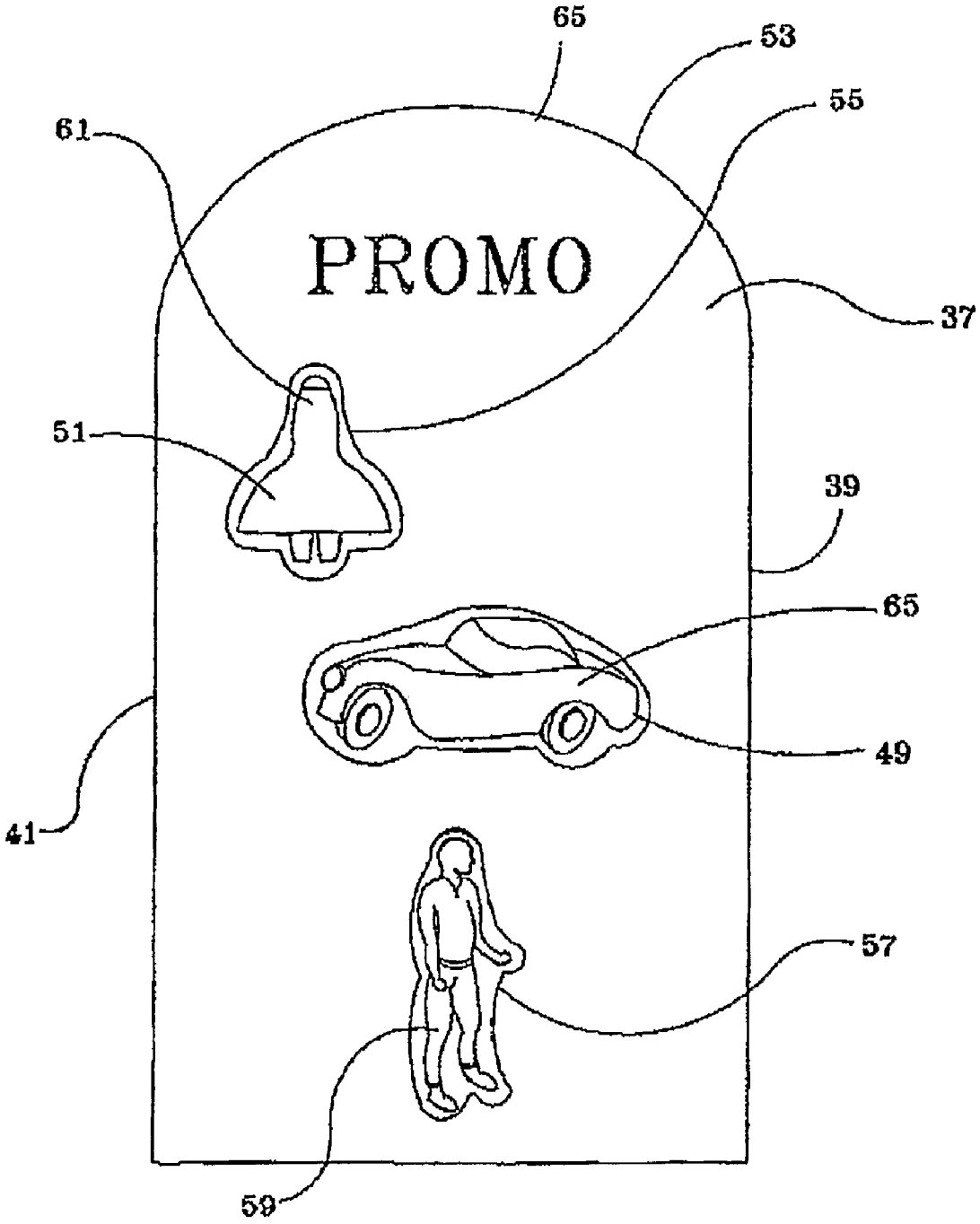
FIG. 5 is a front view of the advertising system illustrating the insert portion and the accompanying objects in an exemplary embodiment of the present invention.

As illustrated in FIG. 1B, the insert portion 37 may have a plurality of outwardly projecting pockets 49. In an exemplary embodiment, the insert portion 37 may have three (3) outwardly projecting pockets 49, however, it should be understood that any number of pockets may be utilized. The outwardly projecting pockets 49 may be adapted for general insertion of an object 51 such as a child toy, electronics, promotional material or any other good and/or services to be displayed to an observer. In an exemplary embodiment, the outwardly projected pockets 49 may be a generally convex surface 55 extending outward from the outside edge 53 of the insert portion 37. This general convex surface 55 may allow for insertion and removal of a plurality of different sized and shaped objects 51 within the pockets 49. Whereby the pockets 49 may be all be of the same dimensions to house various objects 51 for display. However, as illustrated in FIG. 5, the insert portion may be adapted to be an object specific pocket 57. As illustrated in FIG. 5, the object specific pocket 57 may be dimension to house and display a specific object 51 and may be sized only slightly larger than the object 51 to be displayed. For example, as illustrated in FIG. 5, a toy soldier 59 may be utilized and desired for display for children. The object specific pocket 57 may extend outward from the outside edge 53 of the insertion portion and may be shaped as a toy soldier but be slightly larger than the physical size of the solder 57 displayed. This may be advantageous to give the toy soldier 57 additional dimension and specificity. FIG. 5 also illustrates a toy plane 61 and a toy car 65 whereby each would have a specific pocket 57 shaped to fit the toy plane 61 and toy car 65 respectively.

Figure 2:
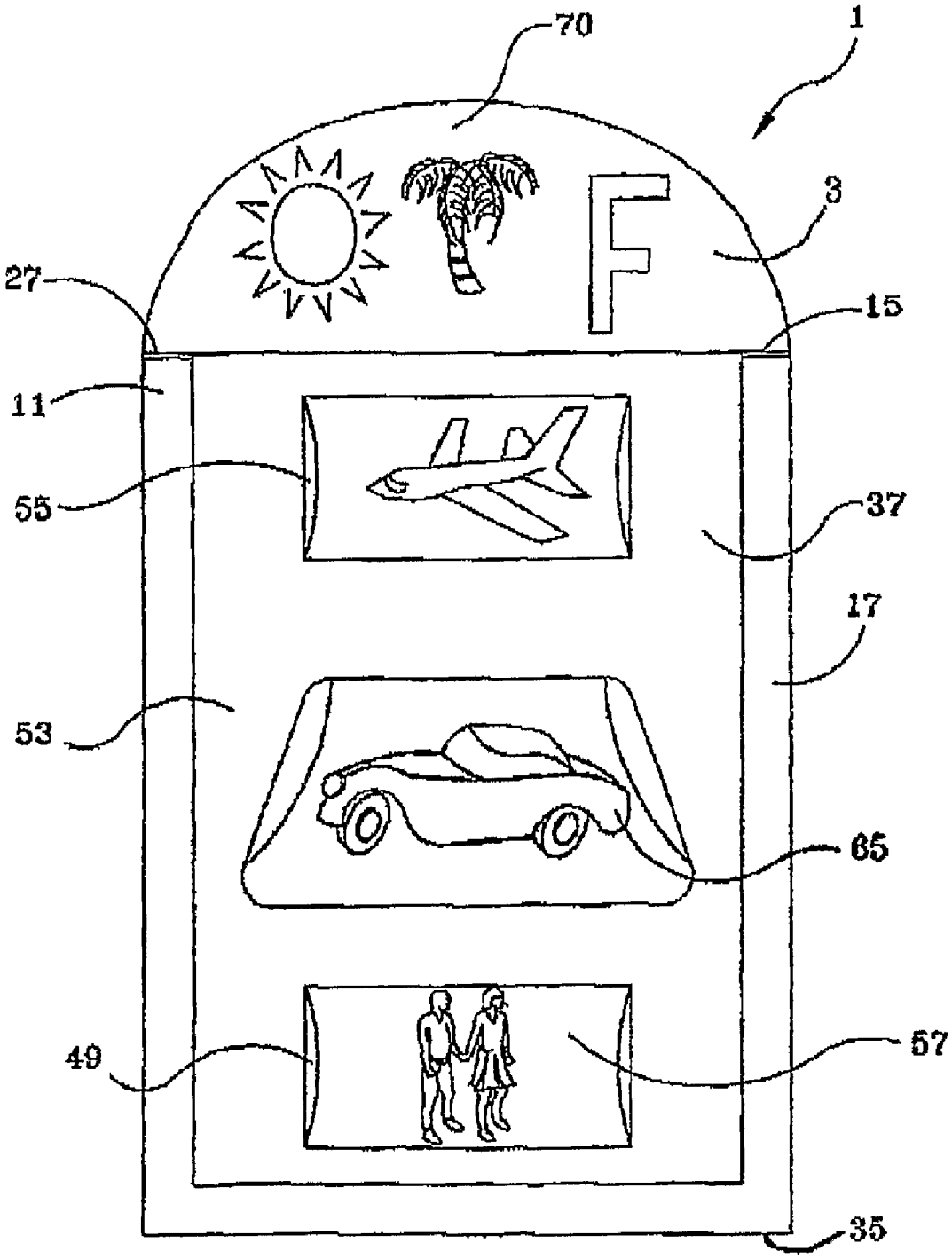
FIG. 2 is a perspective view of the invention showing the insert portion and the backboard portion coupled together.

FIG. 2 illustrates the backboard portion 3 and the insert portion 37 whereby the insert portion 37 is fully inserted into the backboard portion 3. As can be seen from the figure, the distal end 27 of the first side 9 of the backboard portion is adapted for insertion and securement of the insert portion 37 thereto. Additionally, the top edge 65 of the insertion portion 37 may be adapted to be completely visible and whereby the top edge 69 of the backboard portion 3 may extend beyond the top edge 65 of the insert portion 37. Further the top edge 69 of the backboard portion 3 may have printed indicia 70 thereon for further illustration to a user.

Figure 3:
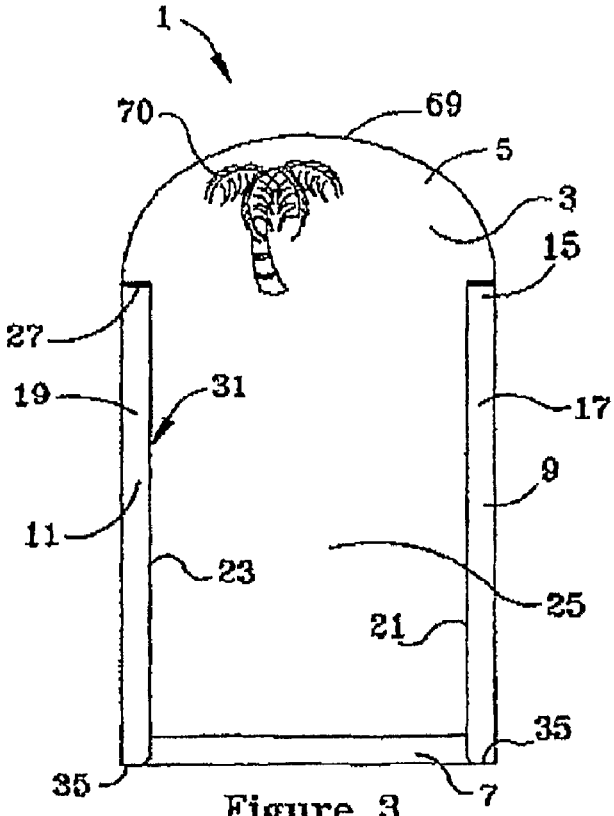
FIG. 3 is a front view of the advertising system illustrating the backboard portion of the invention in an exemplary embodiment of the present invention.

FIG. 3 illustrates the top edge 69 of the backboard portion 3 whereby the top portion 5 of the backboard portion 3 may be shaped to extend away from the side edges 9, 11 of the backboard portion 3. In an exemplary embodiment, the backboard portion 3 may be semicircular 75 as illustrated in FIG. 3. However, it should be understood that the top portion 5 of the backboard portion 3 may be any shape as long as it extends away from the top edge 73 of the side edges 9, 11. The top portion 5 of the backboard portion 3 may be utilized to illustrate additional information, logos or any other information to a viewer/observer that is not contained within the insert portion 37 of the advertising system 1.

Figure 4:
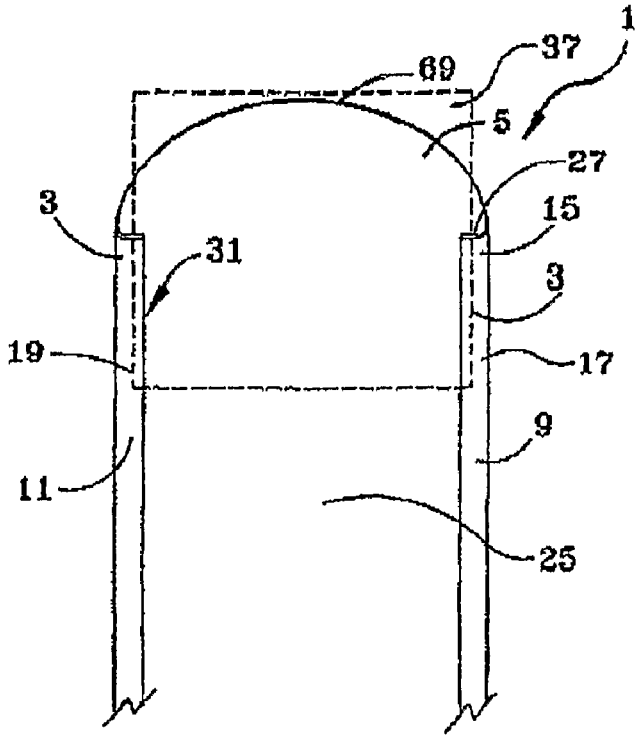
FIG. 4 is a front view of the advertising system illustrating the backboard portion and the insert portion being inserted into the backboard portion in an exemplary embodiment of the present invention.

FIG. 4 illustrates the backboard portion 3 whereby the insert portion 37 may be inserted in the space 31 created by the distal end 27 of the first side 9 of the side section 9 and the distal end 73 creating the second space 45 of the second side section 11. As can be seen in FIG. 4, the insertion portion 37 is inserted into the spaces 31, 45 in the backboard portion 3 to be secured thereto. Additionally, the insert portion 37 may be removed and replaced with another insertion portion (not shown) having different objects secured thereto. The backboard portion 3 as shown in FIG. 1 may have a plurality of different indicia 70 printed directly thereto, whereby even if no insertion portion 37 is secured thereto, the backboard portion 3 may serve as an independent, stand alone advertising tool. The backboard portion 3 may have indicia 75 printed thereon that may be covered up by the insert portion 37 and further wherein the insert portion 37 is removed to be replaced with another interchangeable insert portion 37, the printed indicia 70 on the backboard portion 3 may be used for advertising while awaiting insertion of a subsequent insert portion 37.

Thus, specific embodiments and applications of modular overhead storage have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

The invention claimed is:

1. An apparatus for advertising promotional material, the apparatus comprising:

a backboard portion having a front, back and first and second sides wherein the backboard portion has indicia printed thereon;

an insert portion having indicia thereon, wherein said insert portion comprises a single insert including multiple three-dimensional projections, each comprising separate object specific pockets that are completely self contained and configured to display one object directly;

said insert portion is adaptable for removable coupling with the background portion and further wherein said insert portion has at least a three dimensional object contained therewithin; and said background portion having an attachment means wherein said attachment means is configured to be coupled to the insert portion of the apparatus wherein the insert portion is removable from coupling with the backboard portion, and further wherein the indicia on the backboard portion is covered by said insert portion when said insert portion is coupled to the background portion and becomes visible to a viewer when said insert portion is removed from the background portion.

2. The apparatus described in claim 1 wherein the multiple three-dimensional projections, each comprising separate object specific pockets configured to display one object directly, are spaced apart from each other within the insert.

3. The apparatus described in claim 1 wherein said backboard is larger than said insert portion such that when insert portion is coupled with said backboard portion, a segment of the backboard portion is still visible beyond the insert portion.

4. The apparatus described in claim 1 wherein said backboard portion has an attachment means to secure the insert portion wherein said attachment means envelops a segment of the insert portion.

5. The apparatus described in claim 1 wherein said insert portion may be removably coupled to said backboard portion wherein when removed, a second insert potion may be adapted for coupling with the backboard portion and further wherein, after said insert portion is removed, the backboard portion may be left without an insert portion.

6. A method for advertising, the method comprising the steps of:

providing a backboard portion of an advertising sign wherein said backboard portion has a front side, back side and a first and second side and further wherein the backboard portion has printed indicia thereon;

providing a removable insert portion wherein the backboard portion is larger in size than the insert portion, wherein said insert portion comprises a single insert including multiple three-dimensional projections, each comprising separate object specific pockets that are completely self contained and configured to display one object directly;

adapting said insert portion for coupling with the backboard portion, the insert comprising a single insert including multiple three-dimensional projections, each comprising separate object specific pockets configured to display one object directly;

presenting said insert portion with an indicia thereon such that when the insert is coupled to the backboard the indicia is covered and such that when said insert portion is removed from coupling with the backboard portion, said printed indicia on the backboard portion becomes visible for advertising use; and displaying the combination of the backboard and insert portions for use in an advertising use.

7. The method of claim 6, wherein the method comprises the additional step of:

inserting a three dimensional object into the insert portion for display therein.

8. The method of claim 6, wherein the method comprises the additional step of:

providing a backboard portion which is larger in size than the insert portion and wherein when the insert portion and the blackboard portion are coupled together, a segment of the backboard portion is still visible beyond the insert portion.

9. The method of claim 6, wherein the method comprises the additional step of:

providing the backboard portion with an attachment means for detachable coupling of the backboard portion with the insert portion.

10. The method of claim 6, wherein the method comprises the additional step of:

removing said insert portion from coupled configuration with the backboard portion and replacing said insert portion with a second different insert portion.

* * * * *